United States Patent [19]

Ling

[11] Patent Number: 4,887,441

[45] Date of Patent: Dec. 19, 1989

[54] QUICKLY OPENABLE COMBINATION PADLOCK OF PUSH-BUTTON TYPE

[76] Inventor: Chong-Kuan Ling, P.O. Box 53-58, Taipei, Taiwan

[21] Appl. No.: 368,555

[22] Filed: Jun. 20, 1989

[51] Int. Cl.[4] ..... E05B 37/06

[52] U.S. Cl. ..... 70/25; 70/312

[58] Field of Search ..... 70/25, 26, 24, 30, 52, 70/312

[56] References Cited

U.S. PATENT DOCUMENTS

| | | | |
|---|---|---|---|
| 1,126,417 | 1/1915 | Dizmacsek | 70/25 |
| 1,823,650 | 9/1931 | Gordon | 70/25 |
| 1,940,789 | 12/1933 | Diaz | 70/25 |
| 2,008,565 | 7/1935 | Segal | 70/25 |
| 3,386,271 | 6/1968 | Morin | 70/25 |
| 3,388,572 | 6/1968 | Morin | 70/25 |
| 4,450,698 | 5/1984 | Scelba | 70/312 |
| 4,621,509 | 11/1986 | Mizuno | 70/26 |

*Primary Examiner*—Robert L. Wolfe

[57] ABSTRACT

A combination padlock includes a shackle ejector and a push-button slide provided in a lock casing, whereby upon a depression of a push button of the push-button slide to disengage a shackle from the slide, a resilience of the shackle ejector may eject a free end of the shackle for a quick opening of the padlock.

8 Claims, 3 Drawing Sheets

QUICKLY OPENABLE COMBINATION PADLOCK OF PUSH-BUTTON TYPE

BACKGROUND OF THE INVENTION

L. H. Morin disclosed a combination lock with concealed resettable control in his U.S. Pat. No. 3,388,572, which however may have the following drawbacks:

1. When the combination lock is opened by selecting a right opening number of the wheels, the key 50 should be raised to push the element 40 in order to urge the free end 21 of the hasp 17 beyond the lock casing. Since the spring 20 retains the washer 19 secured to a lower end of the hasp 17 to force the hasp 17 downwardly, it requires a bigger force to depress the key 50 in order to open the lock, counteracting the resilience of the spring 20.

2. As shown in his FIG. 1, the key is protruded downwardly when locking the padlock influencing its decorative appearance and increasing its volume inconvenient for handling or storage.

3. The split friction ring 29 is frictionally retained in each wheel 24 so that when resetting a new combination by rotating the wheels 24, the key element 31 formed on the hasp shank 16, as engaged with each ring slot 29' as shown in his FIG. 4 when upwardly supporting the free end 21 of hasp 17 by the key 50, element 40, will firmly hold each ring 29 while rotating the wheel 24, thereby easily causing wearing on a periphery of each ring 29 to lose its frictional engagement with each wheel 24. After using a time period, the wheel 24 may not synchronously drive the ring 29 during rotating the wheels 24 possibly causing a difficulty to obtain an opening combination of the lock.

The present inventor has found the drawbacks of a conventional padlock and invented the present combination padlock easily openable.

SUMMARY OF THE INVENTION

The object of the present invention is to provide a combination padlock having a shackle ejector and a push-button slide provided in a lock casing, whereby upon a depression of a push button of the push-button slide to disengage a shackle from the slide, a resilience of the shackle ejector may eject a free end of the shackle for a quick opening of the padlock.

DETAILED DESCRIPTION

Figure 1:
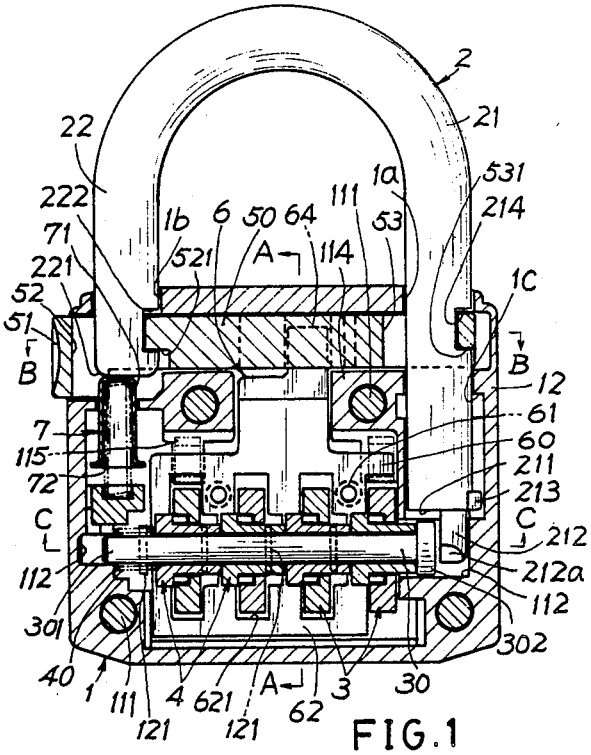
FIG. 1 is a front view cut-away illustration of the present invention when locked.

As shown in FIGS. 1–10, the present invention comprises: a casing 1, a shackle 2, a plurality of dials 3, a plurality of sleeves 4, a push-button slide 5, a seesaw controller 6, and a shackle ejector 7.

Figure 2:
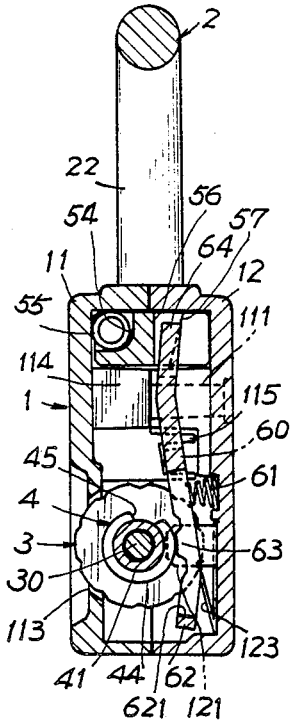
FIG. 2 is a side-view sectional drawing of the present invention when viewed from I—I direction of FIG. 1.
Figure 7:
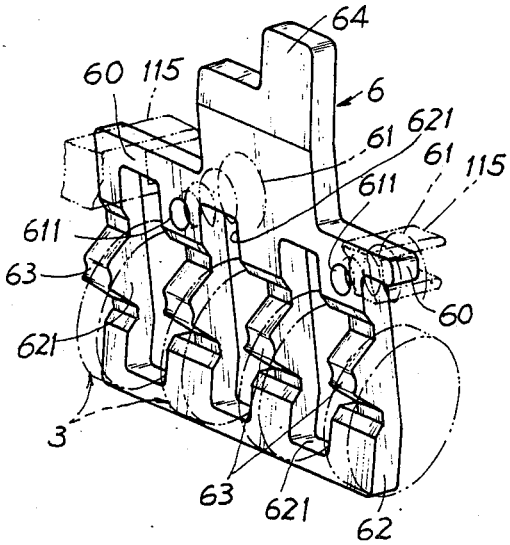
FIG. 7 shows a seesaw controller of the present invention.

The casing 1 is composed of a first cover 11 and a second cover 12 combinably forming the casing 1. The first cover 11 includes a plurality of stems 111 for connecting the second cover 12. Both covers 11, 12 are formed a pair of semi-cylindrical holes 112, 122 respectively, both holes 112, 122 combinably forming a cylindrical hole for rotatably mounting a shaft 30 of the dials 3. A plurality of slots 113 are formed in the first cover 11 to protrude the plural dials 3 beyond the cover 11. An extension seat 114 is formed in an upper portion of the first cover 11 for slidably supporting the push-button slide 5 thereon. A pair of brackets 115 are formed on a central wall portion inside the first cover 11 protruding towards the second cover 12 for pivotally securing two side arms 60 of the seesaw controller 6 as shown in FIGS. 2 and 7.

The second cover 12 includes a plurality of vertical tapered extensions 121 protruding laterally towards the first cover 11, each vertical extension 121 operatively engageable with each divergent notch 45 of the sleeve 4 for engaging each sleeve 4 when resetting a new combination of the padlock. A spring plate 123 is formed in a lower portion of the second cover 12 to resiliently engage each recess 321 formed in a periphery of each dial 3 for a stepwise dialing operation of the dial 3.

The shackle 2 generally formed as an inversed U-shape includes a long leg 21 and a short leg 22 respectively engaged with two sockets 1*a*, 1*b* formed in the casing 1 as shown in FIG. 1. The long leg 21 includes: a lower end portion 211 having a semi-cylindrical extension 212 protruding downwardly, an extension key 213 formed on a lower periphery of the long leg 21 rotatably retained in an annular seat 1*c* formed in the casing 1 for limiting the shackle 2 when opening the padlock, and a recess 214 formed in a middle portion of the long leg 21. The short leg 22 has a bottom portion 221 resiliently ejected by the ejector 7 when opening the padlock and a recess 222 formed in a lower portion of the leg 22, next to the bottom portion 221.

Figure 6:
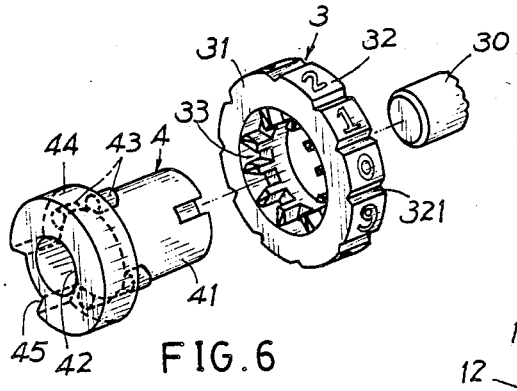
FIG. 6 is a perspective view of a dial and a sleeve of the present invention.

Each dial 3 includes an annular ring 31 formed with a plurality of numerals 32 such as 0, 1, 2 . . . 9 on an outer periphery of the ring 31 with every two neighbouring numerals 32 partitioned with a recess 321 recessed in the outer periphery of the ring 31, and a plurality of key grooves 33 formed in a cylindrical bore portion inside the ring 31 operatively engageable with plural keys 43 formed on the sleeve 4 as shown in FIG. 6.

Figure 4:
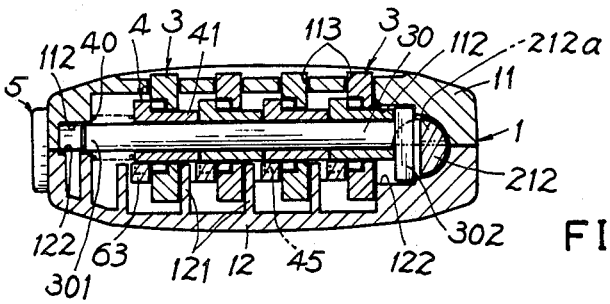
FIG. 4 is a cross sectional drawing of the present invention when viewed from III—III direction of FIG. 1.
Figure 9:
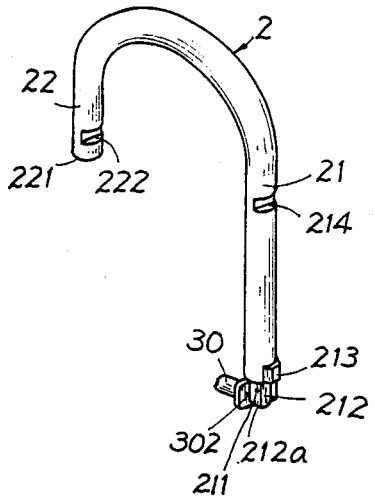
FIG. 9 is an illustration shown a resetting operation by the shackle of the present invention.

Each sleeve 4 includes: a cylinder 41 having a central hole formed therethrough for rotatably mounting a shaft 30, a flange 44 enlarged from the cylinder 41, a divergent notch 45 formed in a periphery of the flange 44 divergently enlarged radially, and a plurality of extension keys 43 formed on a periphery between the flange 44 and the cylinder 41. The shaft 30 for rotatably securing the dials 3 includes a shaft shank 301 rotatably engageable with the shaft holes 112, 122 of the casing 1, and a flange 302 enlarged on one end of the shank 301. The flange 302 may be retracted by an inclined surface 212*a* formed on a semi-cylindrical extension 212 of the long leg 21 of shackle 2 as shown in FIGS. 1, 4 and 9 when the padlock is opened to eject the shackle free leg 22 upwardly and the shackle 2 is rotated at an angle of 90 degrees and the depressed to thrust the flange 302 rearwardly by the inclined surface 212*a* as shown in FIGS. 4 (dotted line) and 9.

The push-button slide 5 includes: a push button 51 formed on an outer portion of the slide 5 protruding beyond the casing 1, an elongate member 50 having two shackle holes 52, 53 formed therein each hole having a diameter larger than either of the two legs 22, 21 of the shackle 2, a restoring spring 55 inserted in a socket 54 formed in the elongate member 50 and retained on a wall of the cover 11 normally urging the push button 51 outwardly, a first recess 56 recessed in a side portion of the elongate member 50 opposite to the socket 54 of spring 55 and engageable with a retarding plate 64 of the seesaw controller 6 when locking the present padlock, a second recess 57 next to the first recess 56 having a distance to an inside wall of the second cover 12 shorter than that of the first recess 56 for storing the retarding plate 64 of the seesaw controller 6 when opening the lock and retracting the slide 5 inwardly, two locking extensions 521, 531 respectively formed in two shackle holes 52, 53 (on right side of each hole 52, 53) for engaging two recesses 222, 214 formed on two legs 22, 21 of the shackle 2 when locking the padlock.

Figure 10:
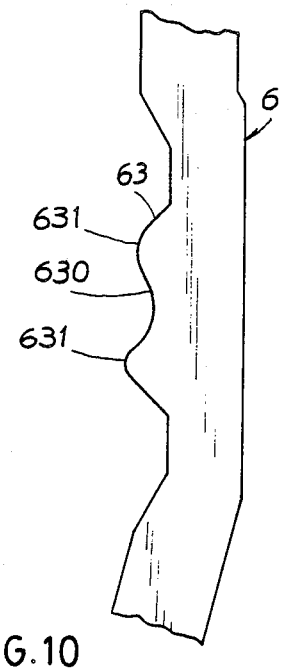
FIG. 10 shows a tapered extension of the seesaw controller of the present invention.

The seesaw controller 6 includes: a pair of side arms 60 pivotally secured on two brackets 115 of the first cover 11, two tensioning springs 61 urging two spring holes 611 each spring 61 retained on the second cover 12 positioned slightly under the two arms 60, a lower plate 62 is formed with a plurality of tapered extensions 63 vertically juxtaposed on the lower plate 62 operatively engageable with the plural divergent notches 45 of the sleeves 4, a plurality of dial sockets 621 each adjacent to each extension 63 and juxtapositional to each extension 63 and an upper retarding plate 64 formed on an upper portion of the controller 6 above the lower plate 62. The tapered extension 63 is formed an arcuate front edge 630 engageable with the divergent notch 45 of the sleeve 4. The arcuate front edge 6530 is formed with two peaks 631 having different heights as shown in FIG. 10 for a rotational sliding of the arcuate edge 630 of the controller 6 on a circumferential surface of the sleeve flange 44 as shown in FIG. 2 in that the contact between the sleeve 4 and the extension 63 is a "point" contact for smooth rotation of sleeve, rather than a frictional "surface" contact.

The shackle ejector 7 includes a plunger 71 having a restoring spring 72 inserted therein and retained on a casing wall to normally urge the bottom portion 221 of the short leg 22 of shackle 2.

Figure 3:
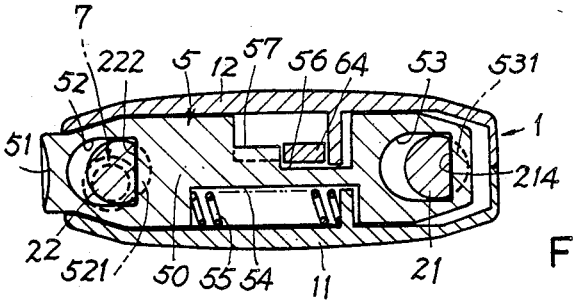
FIG. 3 is a cross sectional drawing of the present invention when viewed from II—II direction of FIG. 1.
Figure 8:
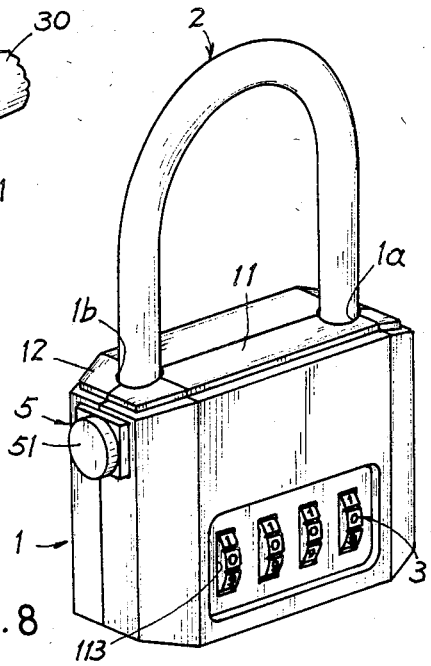
FIG. 8 is a perspective view of the present invention.

When using the present invention as shown in FIG. 8 for locking purpose, the shackle 2 is depressed to allow the two locking extensions 521, 531 to be engaged with two recesses 222, 214 formed in the shackle 2, resulting in locking the shackle 2 in the casing 1. Meanwhile, the dials 3 are rotated to a combination not openable as shown in FIG. 2, in that, the circumferential surface of sleeve flange 44 is disengaged from the tapered extension 63 of the seesaw controller 6 to bias the lower plate 62 of the controller 6 so as to seesawly move the upper retarding plate 64 towards the first recess 56 of the slide 5 as shown in FIG. 2 and 3 thereby locking the lock of which the push button 52 is not depressible.

Figure 5:
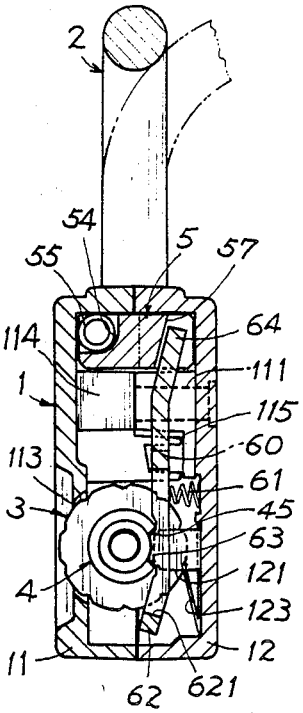
FIG. 5 is a side-view sectional drawing of the present invention when opened.

When opening the present lock, the dials 3 are rotated to the opening number to engage each divergent notch 45 of the sleeve 4 with the tapered extension 63 of the controlled 6 as shown in FIG. 5. The spring 61 will urge the controller 6 to seesawly bias the upper plate 64 towards the second cover 12 to leave from the first recess 56 without obstructing the slide 5, whereby upon a depression of the push button 51 to retract the slide 5 to disengage the extensions 521, 531 from the recessed 222, 214, the shackle ejector 7 will resiliently eject the short leg 22 upwardly beyond the casing 1 to open the padlock. During the opening condition when the slider 5 is retracted inwardly, the upper plate 64 of the controller 6 is positioned in the second recess 57 as shown in FIG. 5. However, when it is locked of the present padlock, the upper plate 64 will be biased to engage the first recess 56 as shown in FIG. 3 for locking the slide 5 and the present invention.

When it is intended to reset a new combination for opening the lock, the shackle 2 as ejected upwardly when the lock is opened is rotated at 90 degrees and then depressed to allow its lower inclined surface 212*a* as shown in FIG. 4 (dotted line) and 9 to thrust the flange 302 of shaft 30 leftwardly to also urge the sleeves 4 leftwardly to disengage from the dials 3, but to engage the extensions 121 formed on the second cover 12 so that the dials 3 can be free rotated for setting a new opening combination. After resetting the combination, the shackle 2 is recovered to its original state and the spring 40 will urge the sleeves 4 to be engaged with the dials 3 for their regular use.

The present invention has the following advantages superior to a conventional padlock, such as Morin's U.S. Patent:

1. When the padlock is dialed to a correct opening combination, the lock can be quickly opened just by depressing the push button 51.

2. It is very easy to reset a new combination just by rotating and depressing the shackle to separate the sleeves 4 from the dials 3, without requiring any additional tool.

3. The structure is very compact for saving handling space, not containing a longer protruding part such as a key 50 taught by Morin's U.S. patent.

4. This invention provides "double locking" effect since both a rotation of the dials 3 to a closed combination and an engagement of the shackle 2 with the slide 5 may doubly ensure the locking of this invention, being safer than the prior art.

I claim:

1. A combination padlock comprising:

a casing combinably formed by two covers; a shackle generally formed as an U shape having a short leg and a long leg, each said leg formed with a locking recess therein;

a plurality of dials of combination numerals rotatably mounted on a shaft formed in said casing;

a plurality of sleeves each said sleeve engageable in each said dial having a divergent notch formed in said sleeve;

a push-button slide having an elongate member horizontally slidably held in said casing having two vertical shackle holes formed therethrough for passing two said legs of said shackle, each said shackle hole being recessed inwardly to form a locking extension engageable with each locking recess formed in either said leg of said shackle, said slide having a push button normally protruding outwardly beyond said casing and having a recess formed on a side portion of said elongate member;

a seesaw controller having a pair of side arms pivotally secured in said cover, a lower plate having a plurality of tapered extensions formed thereon each said tapered extension operatively engageable with each said divergent notch of said sleeve when opening said padlock, and an upper plate positioned above said lower plate operatively engageable with said recess of said slide when locking said padlock; and a shackle ejector having a plunger restored by a restoring spring and retained on a wall inside said casing resiliently urging said short leg upwardly beyond said casing when opening said padlock, whereby upon a thrusting of the tapered extension of said lower plate of said seesaw controller by a flange of said sleeve, said upper plate of said controller is biased to engage said recess of said slide to retard the depression of said push button of said slide for locking said padlock.

2. A combination padlock according to claim 1, wherein said seesaw controller further includes a pair of springs positioned under said side arms retained on a cover of said casing normally urging said lower plate towards said sleeve so as to engage said tapered extensions with said divergent notches of said sleeves when opening said padlock.

3. A combination padlock according to claim 1, wherein said tapered extension of said seesaw controller is formed an arcuate front edge engageable with said divergent notch of said sleeve, having two peaks of different heights on two ends of said arcuate edge for a rotatable sliding of said tapered extension on said sleeve.

4. A combination padlock according to claim 1, wherein each said recess formed in either said leg of said shackle is formed at a same side of said shackle.

5. A combination padlock according to claim 1, wherein said long leg of said shackle includes a tapered surface formed on a semi-cylindrical portion formed on a lower end of said long leg operatively retracting said shaft to disengage said sleeves from said dials for resetting a new combination of said dials, when rotating said shackle at an angle of ninety degrees.

6. A combination padlock according to claim 1, wherein said casing is formed a plurality of vertical extensions for operatively engaging said divergent notches of said sleeves when retracted inwardly for resetting a new combination.

7. A combination padlock according to claim 1, wherein said lower plate of said seesaw controller is formed with a plurality of sockets for passing said dials engageable with said sleeves, said sockets of said dials vertically juxtaposed to a plurality of said tapered extensions vertically formed on said lower plate.

8. A combination padlock according to claim 1, wherein said push-button slide is formed a spring socket in one of its side portions, having a second restoring spring inserted in said spring socket for normally urging said slide outwardly to protrude said push button beyond said casing.

* * * * *